US008225754B2

(12) United States Patent
Turner et al.

(10) Patent No.: US 8,225,754 B2
(45) Date of Patent: Jul. 24, 2012

(54) TWO-STROKE INTERNAL COMBUSTION ENGINE WITH VARIABLE COMPRESSION RATION AND AN EXHAUST PORT SHUTTER

(75) Inventors: James William Griffith Turner, Wymondham (GB); David Blundell, Dereham (GB)

(73) Assignee: Lotus Cars Limited, Norfolk (GB)

( * ) Notice: Subject to any disclaimer, the term of this patent is extended or adjusted under 35 U.S.C. 154(b) by 367 days.

(21) Appl. No.: 12/161,738

(22) PCT Filed: Jan. 23, 2007

(86) PCT No.: PCT/GB2007/000235
§ 371 (c)(1),
(2), (4) Date: Jun. 15, 2010

(87) PCT Pub. No.: WO2007/083159

PCT Pub. Date: Jul. 26, 2007

(65) Prior Publication Data

US 2010/0300411 A1 Dec. 2, 2010

(30) Foreign Application Priority Data

Jan. 23, 2006 (GB) ..... 0601303.1

(51) Int. Cl.
*F02B 25/00* (2006.01)
*F02D 15/04* (2006.01)

(52) U.S. Cl. ..... 123/65 PE; 123/48 AA; 123/78 A

(58) Field of Classification Search ..... 123/65 PE, 123/48 R–48 D, 78 R–78 F
See application file for complete search history.

(56) References Cited

U.S. PATENT DOCUMENTS 4,829,946 A 5/1989 Boyesen
5,199,261 A 4/1993 Baker
5,408,979 A 4/1995 Backlund et al.
5,598,813 A 2/1997 Masuda et al.

FOREIGN PATENT DOCUMENTS

AU 710603 B2 9/1997
JP 63065121 3/1988
JP 03083340 A 4/1991
JP 2003148178 A 5/2003
WO 91/17348 A1 11/1991

OTHER PUBLICATIONS

British Search Report dated Apr. 12, 2006 (Corresponding to GB Priority Application).

*Primary Examiner* — Noah Kamen
(74) *Attorney, Agent, or Firm* — Fulwider Patton LLP

(57) ABSTRACT

With reference to FIG. 1A, the present invention provides a two-stroke internal combustion engine comprising: a piston (19) reciprocable within a cylinder (20); an exhaust port (23) allowing communication of the cylinder (20) with an exhaust passage (24), which port (23) is opened and closed by the piston during the reciprocal motion thereof; moveable shutter means (1) for varying the effective area of the exhaust port (23), which shutter means (1) varies the effective area cyclically in a timed relationship to the reciprocal motion of the piston (19) within the cylinder (20); a compression ratio variation mechanism (41) additional to and separate from the moveable shutter means (1) for varying a compression ratio of the cylinder (20); sensor means (12, 14, 34) for measuring one or more operating characteristics of the engine and for generating signals corresponding thereto; and a control unit (11) which processes the signals generated by the sensor means (12, 14, 34) and controls the motion of the shutter means (1) accordingly and control the effective area of the exhaust port (25) and controls the compression ratio variation mechanism (41) to independently vary the compression ratio of the cylinder (20).

22 Claims, 3 Drawing Sheets

41
a
b
1
2
3
4
5
7
19
20
21
22
23
24
25
40

TWO-STROKE INTERNAL COMBUSTION ENGINE WITH VARIABLE COMPRESSION RATION AND AN EXHAUST PORT SHUTTER

RELATED APPLICATIONS

This is a U.S. national phase of PCT/GB2007/000235 filed 23 Jan. 2007, claiming priority from GB 0601303.1 filed 23 Jan. 2006.

BACKGROUND OF THE INVENTION

1. Field of the Invention

The invention relates to a two-stroke internal combustion engine and more particularly to an arrangement for varying the compression ratio of such and the area of an exhaust port of a cylinder of such.

2. Description of the Related Art

In a ported two-stroke engine the skirt of the piston serves to close the ports in the cylinder, one or more of these ports serving to provide a passage for the injection of a fresh charge of air or a fuel/air mixture to the cylinder and one or more other ports serving to provide an exhaust output for the combusted gases. The inlet ports and exhaust ports are arranged in the cylinder so that on downward movement of the piston the exhaust ports are uncovered first, the high pressure differential between the gases in the cylinder and atmospheric pressure causing the combusted gases to flow out of the cylinder into an exhaust passage which leads to an exhaust pipe which delivers the gases to the atmosphere. On further downward motion of the piston the inlet ports are uncovered enabling a fresh charge of pressurised fuel/air mixture to be delivered to the cylinder for combustion. The pressurised delivery of gas also serves to force combusted gases from the cylinder, a process known as scavenging.

In traditional two-stroke engines, the time during which both the inlet and the outlet ports are uncovered is controlled solely by the motion of the actual piston itself, the only means of closing the apertures being provided by the piston. When the piston moves towards the top of the cylinder it closes first the inlet ports and secondly the exhaust ports.

In EP-0526538 there is described a two-stroke engine comprising a moveable shutter for varying the effective area of the exhaust port. The shutter varies the effective area cyclically in a timed relationship to the reciprocal motion of the piston within the cylinder. Sensors measure operating characteristics of the engine and a control unit processes signals generated by the sensors and controls the motion of the shutter accordingly. The shutter is operated by a transmission mechanism which oscillates the shutter between a first position in which the exhaust port has a first effective area and a second position in which the exhaust port has a second smaller effective area. The transmission mechanism is connected to a crankshaft connected to the piston of the engine and comprises a plurality of interconnected links. The shutter is in or close to the second position thereof when the piston passes the shutter when moving from the bottom dead centre position thereof to the top dead centre position thereof. The first position of the shutter is varied by the control unit with changes in sensed operating characteristics of the engine. The shutter is in or close to the first position when the piston passes the shutter when moving from the top dead centre position thereof to the bottom dead centre position thereof. The control unit varies the first position of the shutter with change in sensed operating characteristics to advance or retard the opening of the exhaust passage. The control unit varies the first position of the shutter by varying the amplitude of oscillation of shutter travel between the first and second positions thereof. The control unit decreases the shutter movement to retard opening of the exhaust passage. The second position of the shutter is constant for all engine operating conditions. An electro-mechanical device is connected to one of the interconnected links, the electro-mechanical device being controlled by the control unit to alter the configuration of the interconnected links to vary the cyclical motion of the shutter.

The "effective area" of the exhaust port is the area through which gases may pass to the exhaust passage. The exhaust port itself will have a fixed area, being an aperture machined in the side of the engine's cylinder. The shutter acts to vary the effective area of the exhaust port.

The engine of EP0526538 enables the point at which the combined gases can flow from the cylinder in each cycle to be varied with varying engine characteristics by alteration of the first position of the shutter, (i.e. the position in which the exhaust port has the largest effective area).

Recently to achieve cleaner combustion, engines have been run with Homogeneous Charge Compression Ignition (HCCI). This involves introducing gasoline into a mixture of charge air and combusted gases and then allowing the formation of a roughly homogeneous mixture which ignites on compression (without a spark). The combustion process requires retention of heat and combusted gases in a cylinder.

In EP 0526538 concern was expressed about the retention of combusted gases as a result of the use of the shutter; this was felt undesirable.

SUMMARY OF THE INVENTION

The present invention provides a two-stroke internal combustion engine comprising: at least one piston reciprocable within a cylinder; an exhaust port allowing communication of the cylinder with an exhaust passage, which port is opened and closed by the piston during the reciprocal motion thereof, moveable shutter means for varying the effective area of the exhaust port, which shutter means varies the effective area cyclically in a timed relationship to the reciprocal motion of the piston within the cylinder; a compression ratio variation mechanism for varying a compression ratio of the cylinder, sensor means for measuring one or more operating characteristics of the engine and for generating signals corresponding thereto; and a control unit which processes the signals generated by the sensor means and controls the motion of the shutter means accordingly and controls the compression ratio variation mechanism to vary the compression ratio of the cylinder.

The invention enables HCCI combustion over a large area of an engine operating map (idle, low, medium loads and preferably medium high loads and towards higher speeds), hence enjoying simultaneous emission reduction (NOx and HC) and improved fuel efficiency compared with the four-stroke gasoline equivalent.

In a four-stroke gasoline engine (PFI or GDI) the HCCI operating range is limited to low to medium loads and speeds approaching 4000 rpm, since at idle there is not enough heat to initiate and sustain complete HCCI combustion whilst at high loads the rate of heat release (combustion speed) is too high and can damage the engine. In gasoline applications the trapped exhaust gas is an initiator to the HCCI, which is in contrast to its use in the diesel application where it is used as an inhibitor to the HCCI process. Therefore, in order to maintain the temperatures required for gasoline HCCI the exhaust gas needs to be trapped internally which requires variable valve timing. The minimum requirement for a four-stroke engine would be cam profile switching with twin cam phasers. However, fully variable valve events would be better. There is no doubt that HCCI combustion can drastically reduce NOx however, but the operating range of the engine for such a reduction is quite small and is much less than the operating range of the auto ignition itself. HCCI also has the potential to reduce fuel consumption. The end-of-compression temperature governs the combustion process and hence the heat of the trapped exhaust gas influences this. At light load, it is possible to use a significantly higher quantity of exhaust gas without detonation/excessive combustion rate issues as the temperature of the gas is lower due to the lower fuel requirement. At higher loads, the exhaust gas quantity has to be reduced, as the heat content is higher. The use of variable compression ratio (CR) gives a second controlling option for end-of-compression temperature allowing better optimisation of exhaust gas quantity in order to minimise NOx and widen the auto ignition operating range. The design and implementation of variable CR is, however, technically difficult in a four-stroke engine and inevitably leads to increased engine costs.

In a two-stroke gasoline engine the HCCI operating range is larger due to the nature of the two-stroke cycle itself i.e. its short gas exchange process and large amount of residual exhaust gas. Although two-stroke gasoline engines have demonstrated HCCI at idle, the methods used for this are not feasible for the total operating range of the engine. A higher compression ratio could make this possible whilst using a lower compression ratio would extend the upper HCCI operating range. In a first commercial application, which is likely a 'hybrid' HCCI-SI engine, two-stroke operation provides easier switching between operating modes of HCCI and SI (Spark Ignition) compared to a four-stroke, due to its gas exchange process.

It is also worth mentioning that the pumping work of the two-stroke is lowest at light load and increases (although it is not as bad as a four-stroke engine) as the load increases thus suiting the real world operation of the vehicle. In this case, stratified charging/combustion can be utilised if desired rather than required.

The move towards gasoline direct ignition (GDI) eases the introduction of the two-stroke engine, as this technology would be mandatory to achieve emission/fuel consumption legislation. HCCI was first discovered on the two-stroke engine and has been found to have a wider operating range than the four-stroke engine.

The simple combustion chamber of a ported two-stroke engine allows easy variation of CR through the application of a junk ringed head (similar to an upside down piston). The application of this makes two way catalytic conversion a real possibility as NOx generation using auto ignition should be very low. The variable CR has no negative impact on intake pumping work on the two-stroke, unlike the four-stroke in which the pumping work increases with increasing CR.

The shutter varies the angle-area of the exhaust port aperture and hence can be used to keep the time-area requirements appropriate throughout the speed range of the engine. If the shutter is also varied at constant (or varying) speed whilst changing load condition, then varying the exhaust port aperture will influence the scavenging efficiency to effectively give control of the mass of trapped exhaust residuals. This will influence the initiation/control of HCCI. A secondary control system which further improves HCCI operation is provided by a wide varied range of CR. This offers significant variation to end of compression charge temperature, allowing this to be increased at light load to lower the operating range to possibly include idle. When the combustion becomes too strong at higher speeds/loads, the variable CR mechanism allows a wider and more optimised range of HCCI operation with less compromise to the operating cycle and the gas exchange process.

BRIEF DESCRIPTION OF THE DRAWINGS

Preferred embodiments of the present invention will now be described with reference to the accompanying drawings, in which:

FIGS. 1A to 4A are simplified diagrammatic cross-sections of a piston and cylinder arrangement according to the invention showing the arrangement at different stages during the cycle;

FIGS. 1B to 4B are simplified diagrammatic cross-sections of a piston and cylinder arrangement according to the invention showing the same sequence as FIGS. 1A to 4A but with the arrangement adjusted to account for a change in an operating characteristic of the engine;

DETAILED DESCRIPTION OF THE INVENTION

Figures 1A, 1B, 2A, 2B, 3A, 3B, 4A, 4B:
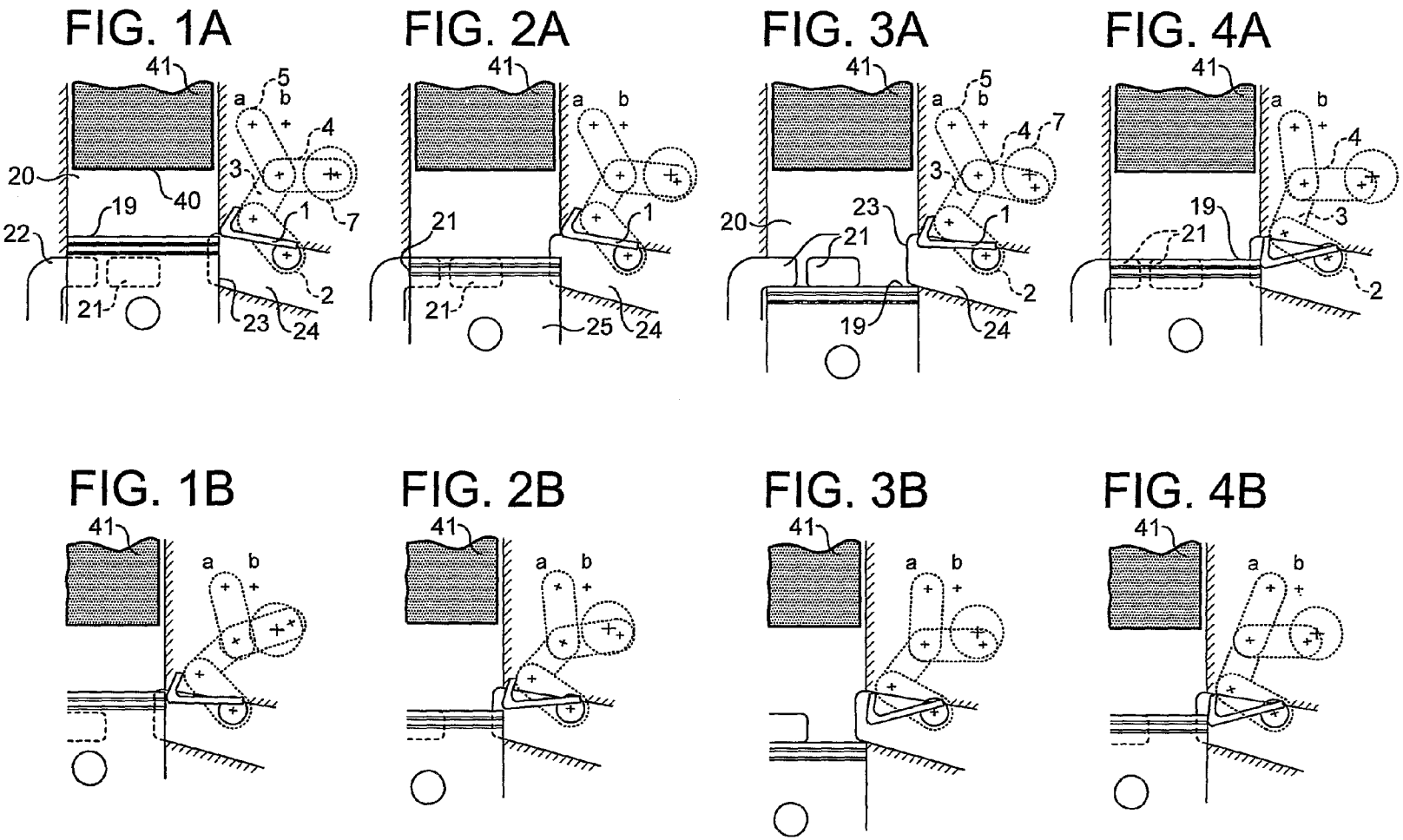

FIGS. 1A to 4A show a high speed/high load operation condition of the engine. FIG. 1A shows a piston 19, a cylinder 20, a plurality of inlet ports 21, inlet passage 22, an exhaust port 23 and an exhaust passage 24. Operable in the exhaust passage to vary the effective area of the exhaust port 23 is an shutter 1, operated by a mechanism including first link 2, second link 3, third link 4, fourth link 5 and crankshaft 7. The fourth link 5 is connected to a servo motor (not shown in FIG. 1, but shown in FIG. 5 and described later in the specification) by fifth link 6. The piston 19 is connected via a conventional gudgeon pin and connecting rod (not shown) to an output crankshaft (not shown). The output crankshaft is connected by the pulley belt to the crankshaft 7.

The cylinder 20 is defined in part by a movable end surface 40 provided by a ringed junk head 41 slidable axially along the cylinder 20. The junk head 41 is movable to vary the compression ratio in the cylinder 20. Piston rings (not shown) provide a seal between the junk head 41 and the surrounding cylinder 20.

FIG. 1A shows the piston 19 at a point when the piston and piston skirt 25 just covers the exhaust port 23. Typically this occurs when the output crankshaft has rotated 85° from top dead centre. The piston skirt 25 covers completely the inlet ports 21. The shutter 1 is withdrawn into the wall of exhaust passage 24. The gases in the cylinder in FIG. 1 have been combusted.

FIG. 2A shows the piston 19 at a point when it has moved downwards from its position in FIG. 1A, on rotation by roughly 28° of the output crankshaft. Since the crankshaft 7 is connected to the output crankshaft, the crankshaft 7 has rotated a corresponding degree, causing corresponding motion of the four links 2 to 5. The motion is not however sufficient to cause the shutter 1 to enter the exhaust port 24. The exhaust port 23 has been uncovered by the piston 19 and hence the combusted gases present in the cylinder at high pressure flow out of the cylinder through the exhaust port 23.

FIG. 3A shows the piston when it has moved downward from its position in FIG. 3A to bottom dead centre. The piston 19 has uncovered the inlet ports 21 and pressurised fuel/air mixture can enter the cylinder 20 through the inlet ports 21.

The pressurised fuel/air mixture drives remaining combusted gases from the cylinder into the exhaust passage 24. The pressurised fuel/air mixture drives remaining combusted gases from the cylinder into the exhaust passage 24. However, excessive loss of fuel/air mixture is prevented by the reduction of the effective area of the exhaust port 23 by the shutter 1. The reduction in the effective area of the exhaust port occurs since movement of the output crankshaft with the downward motion of the piston 19 between FIGS. 3A and 4A has caused the crankshaft 7 to move by the previously mentioned pulley and belt means. The movement of the crankshaft 7 causes motion of the links 2,3 and 4 in such a way that the shutter 1 is pivoted into the exhaust passage 24, reducing the effective area of the exhaust port 23.

In FIG. 4A the piston 19 has begun its upward motion and the piston skirt 25 has closed the inlet port 21. Typically this would occur after the output crankshaft has rotated 247° from Top Dead Centre. The motion of the piston between FIG. 5A and FIG. 4A causes a rotation of the output crankshaft which results in a corresponding rotation of the crankshaft 7. The rotation of the crankshaft 7 via the link members 2, 3 and 4 causes the shutter 1 to rotate from the position shown in FIG. 4A and further decrease the effective area of exhaust port 23. The reduction in effective area of the exhaust port 23 by the shutter 1 enables the piston 19 to close the port 23 at an earlier stage in its upward motion than would have otherwise been possible. The earlier closure of the port enables a longer period of compression of the fuel/air mixture, allowing a higher peak pressure to be achieved and greater engine thermal efficiency.

In all of FIGS. 1A to 4A, the junk head is retained in an uppermost position in which the compression ratio in the engine is at a minimum.

FIGS. 1B to 4B show a low speed/low load operating condition of the engine. FIG. 1B shows the piston in the same position relative to the cylinder as 1A. The junk head 41 has been lowered to its lowermost position to increase the compression ratio in the cylinder 20 to its maximum. Also the shutter position in FIG. 1B does not correspond to that of FIG. 1A. The control system has acted to take account of engine load and engine speed and has caused the servo-motor to rotate the fifth link arm 6 such that the configuration of the four link arms 2 to 5 is adjusted. The adjustment of the geometrical arrangement of the four link arms 2 to 5 from that of FIG. 1A to that of FIG. 1B reduces the extent of shutter travel. The geometry of the arrangement is such that the maximum reduction of area of the exhaust port 23 by the shutter 1 is the same for all positions of the controlling fifth link 6. However, when the fourth link 5 is in the position shown in FIGS. 1B to 4B the shutter is never fully retracted into the wall of the exhaust passage as shown in FIG. 1A. The decreased shutter travel of FIGS. 1B to 4B allows less fuel/air mixture to be exhausted without combustion than the full shutter travel of FIGS. 1A to 4A. It also allows the time at which the interior of the cylinder is open to the atmosphere to be delayed when compared with both a normal two-stroke engine and also when compared with the arrangement of FIGS. 1A to 5A. This enables retention of combusted gases in the cylinder 10 to facilitate HCCI.

In a preferred embodiment of the present invention the level of lowest part of the shutter 1 when at its lowest level corresponds to a point below the highest point of the inlet apertures 21. The shutter is at its lowest position just after the piston fully closes the inlet apertures 21 on its upstroke. However, the exhaust passage is opened to the cylinder before the piston uncovers the inlet apertures on its downstroke. This allows exhaustion of combusted gases before the fresh charge of fuel/air mixture is delivered. Therefore, the timing of the opening and closing of the exhaust port is "asymmetric" with respect to piston position. The exhaust port is opened when the piston is at a higher position with respect to the cylinder in its downstroke than the position of the piston when the exhaust port is closed in its upstroke. The system allows asymmetric timing of the movement of the shutter with respect to the position of the piston, and varies the asymmetry in accordance with varying engine parameters such as load, speed and temperature.

The configuration of FIGS. 2A to 5A is designed for high speeds and/or high loads. In these conditions the combustion in the engine will be occasional by spark ignition. To prevent unwanted pre-ignition (or "pinking") the compression ratio is reduced to its lowest. The time available for exhaustion of combusted gases is less than at low speeds and hence the shutter should be retracted fully so as not to hinder the exhaust process. At part-load and low load operations, the engine is operated using HCCI combustion. This is facilitated by trapping exhaust gases in the cylinder for mixing with the fresh charge air and fuel to achieve the conditions necessary for HCCI. The raising of the compression ratio also assists this by raising the compression end temperature. The partially closed shutter acts to prevent all the combusted gases being exhausted, to effectively "trap" combusted gases in the cylinder for mixing with the charge air and fuel next delivered. The arrangement of FIGS. 2B to 5B also increases the torque provided by the engine at low speeds since the opening of the exhaust passage to the cylinder is delayed and hence the period during which the expanding combusted gases act on the piston increased. Also the compression ratio is increased by moving the junk head 41 to achieve a higher end of combustion temperature.

Figure 5:
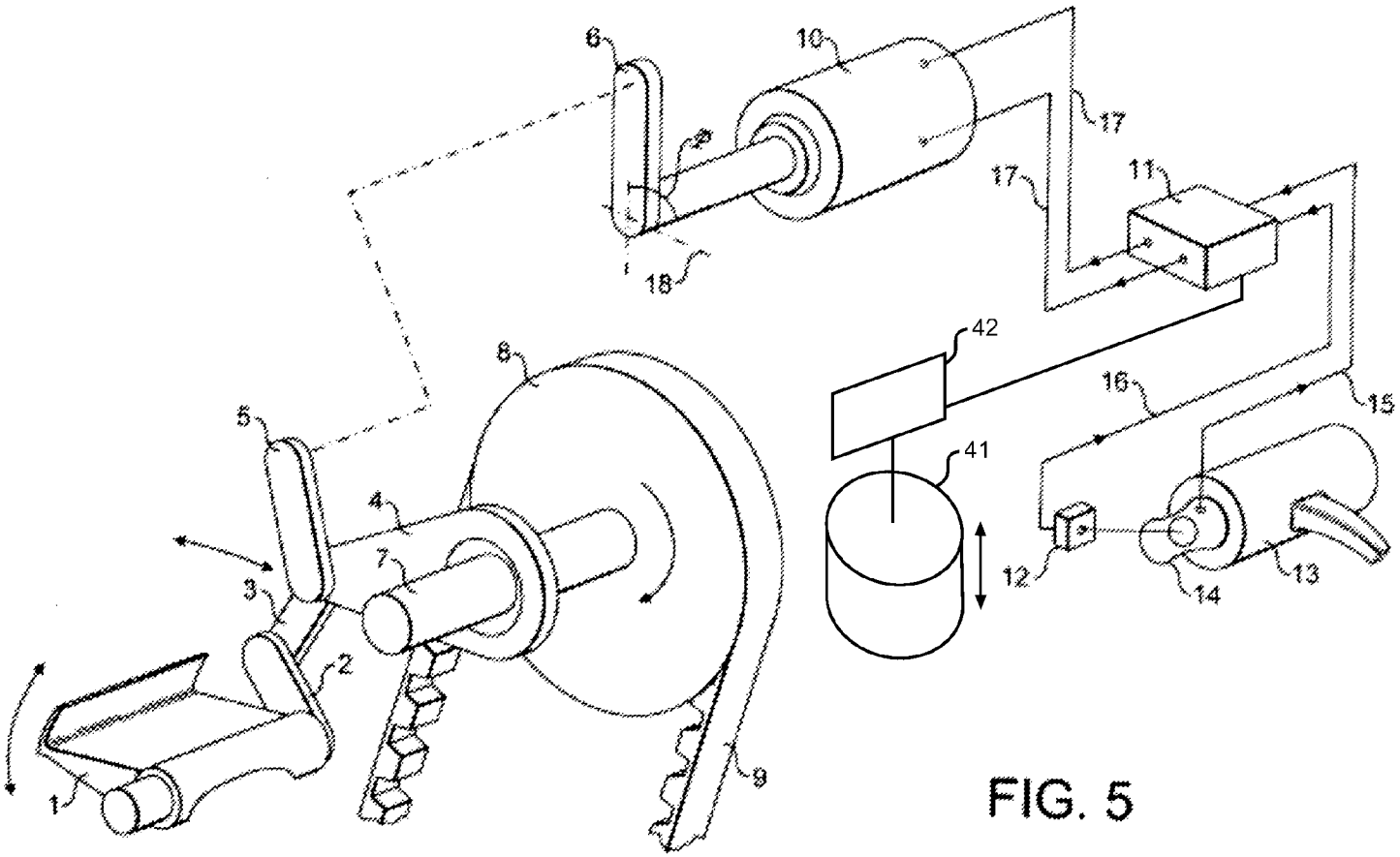
FIG. 5 is a schematic representation of one embodiment of the invention.

FIG. 5 shows the shutter 1, the first link 2, the second link 3, the third link 4, the fourth link 5, the fifth link 6, a crankshaft 7 (the link 4 has an aperture in which rotates an eccentric which rotates with the shaft 7) a pulley 8, a belt 9 driven from the engine output crankshaft (not shown), a servo-motor 10, a control unit 11, sensors 12 and 14 and an inlet manifold 13. An electrical sensor 14 is disposed in the inlet manifold to measure the gas pressure therein. The sensor sends a signal via a line 15 to the control unit 11. An engine speed sensor 12 measures the rotational speed of the engine in which the arrangement is present. The engine speed sensor 12 sends a signal to the control signal 11 via a line 16. The control unit 11 comprises electronic circuiting which compares and combines the signals it receives in accordance with pre-programmed instructions. The control unit 11 sends an instruction signal to servo-motor 10 via lines 17. The signal instructs the servo-motor to rotate the fifth link 6 to a required angle Φ with regard to an arbitrary fixed reference 18.

The electronic control unit determines, according to pre-programmed instructions, the best combination of compression ratios and effective port area for all speeds and loads.

At low engine speeds the decreased shutter movement allows the pressure on the piston due to expansion of the combusted gases to provide power for a greater fraction of the engine cycle by the partial closure of the exhaust port on the downward motion of the piston. The instant in the cycle at which the exhaust port is open to the interior of the cylinder can be delayed for up to approximately 14° rotation of the output crankshaft as compared with an arrangement without a shutter. This allows the retention of exhaust gases for mixing with the fresh charge of fuel/air mixture and thus permits HCCI operation.

Figure 7:
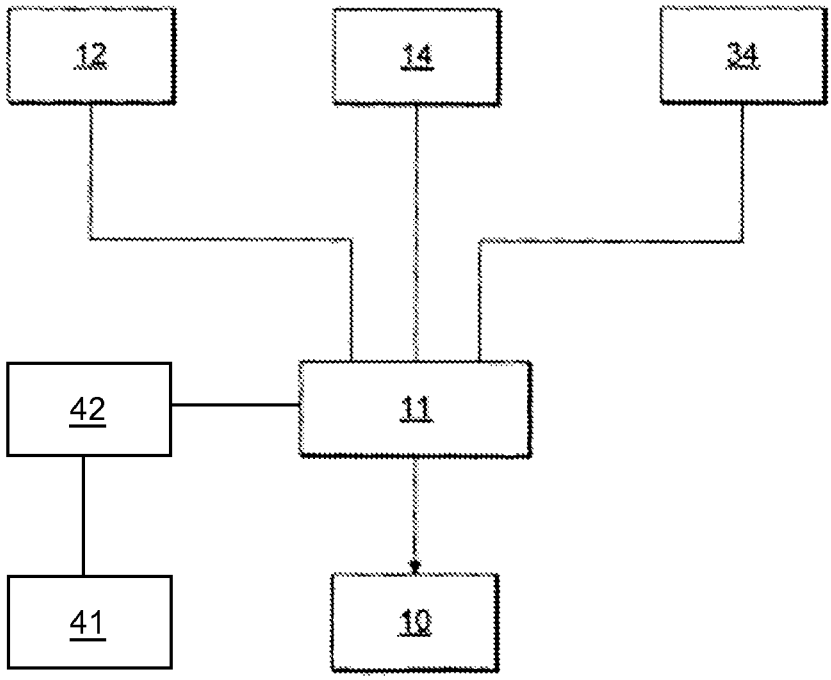
FIG. 7 shows a typical control scheme for an embodiment of the invention.

A control schematic for the control unit 11 is shown in FIG. 7. In a preferred embodiment the control system of the invention incorporates three sensors 12, 14 and 34. The sensor 12 measures engine speed typically by measuring the speed of rotation of the crankshaft rotated by the working pistons of the engine. The sensor 14 measures engine load for instance by measuring the pressure of gases in the inlet manifold (as shown in FIG. 1) or by an airflow meter monitoring flow of gases into the cylinder. The sensor 34 measures the temperature of the coolant of the engine.

The control unit 11 controls the servo-motor 10 to vary the point at which the shutter opens the exhaust passage to the working cylinder. The exhaust passage opening point is calculated in terms of degrees before piston bottom dead centre and is approximately proportional to the sensed engine speed, with maximum engine speed requiring maximum travel of the shutter 1 and maximum opening time for the exhaust aperture. The control unit 11 also controls an actuator 42 (e.g. a hydraulic actuator), to move the junk head to vary the compression ratio in the cylinder having regard to engine speed and/or load.

Whilst the preferred embodiments described above uses a servo-motor to rotate the link 6, any electro-mechanical device could be used that could rotate the link 6 in the required manner. For instance, a hydraulic actuator could be used, the piston of such actuator being connected to a link pivoted roughly halfway along its length, movement of the piston causing the link to rotate about its pivotal axis.

To obtain the full advantage of the invention disclosed herein, the shutter should be formed so that the shape of its lower edge conforms as closely as possible to the shape of the top of the exhaust passage, such that when the shutter is retracted and the exhaust apertures initially opened in the high speed operation mode, the gas velocity being at its highest, there is a minimum of disturbance of the flow passing through the exhaust passage. This way, the performance of the engine is not detrimentally affected by obstruction of the flow of the combusted gases through the exhaust passage.

Figure 6:
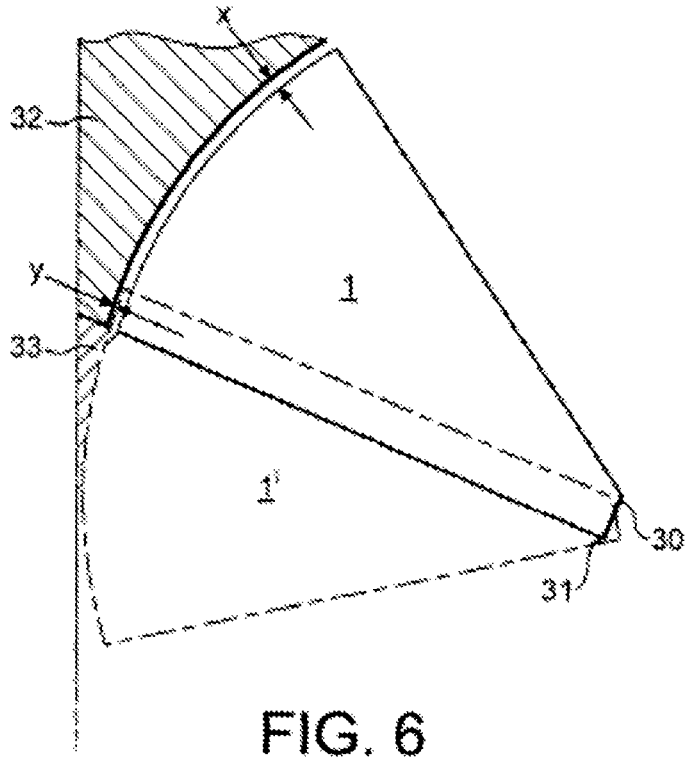
FIG. 6 shows a detail of a preferred embodiment of the invention.

A detail of the shutter arrangement can be seen in FIG. 6. In FIG. 6 the shutter is mounted such that it pivots about the point 30, which is eccentric of the point 31 on the lowermost edge of the shutter 1. The shutter 1 can be seen in its retracted position within the recess in the exhaust passage and also at 1' in a second position reducing the area of the exhaust port. The clearance between the shutter and the housing 32 is reduced as the shutter reaches its lowermost point due to the offset. This can be seen at X and Y in the FIG. 6, X showing the clearance that would prevail without offset and Y showing the clearance that prevails with offset. This has the advantage of reducing the volume 33 formed between the piston and the shutter which is a source of hydrocarbon emissions through the exhaust passage and a loss of power. It also has the advantage of reducing the leakage path between the shutter and the working piston.

Whilst above variation of compression ratio is achieved by the movement of a ringed junk head in a cylinder, other methods of varying compression ratio could be used instead (e.g. by having a piston of variable length or a cylinder block pivotable about an axis to vary the uppermost limit of piston motion in each stroke).

Whilst above the shutter mechanism is described and illustrated (in FIG. 5) having a crankshaft 7 driven by a pulley 9, the crankshaft 8 and pulley 9 could be omitted if the main crankshaft of the engine is provided with an eccentric drive driving the mechanism.

What is claimed is:

1. A two-stroke internal combustion engine comprising:

at least one piston reciprocable within a cylinder that is defined in part by a movable end surface provided by a junk head slidable axially therein;

an exhaust port allowing communication of the cylinder with an exhaust passage, which port is opened and closed by the piston during the reciprocal motion thereof;

moveable shutter means for varying the effective area of the exhaust port, which shutter means varies the effective area cyclically in a timed relationship to the reciprocal motion of the piston within the cylinder;

a compression ratio variation mechanism additional to and separate from the moveable shutter means for varying a compression ratio of the cylinder, the compression ratio variation mechanism comprising an actuator for sliding the junk head to vary the compression ratio in the cylinder;

sensor means for measuring one or more operating characteristics of the engine and for generating signals corresponding thereto; and a control unit which processes the signals generated by the sensor means and controls the motion of the shutter means accordingly to control the effective area of the exhaust port and controls the compression ratio variation mechanism to vary the compression ratio of the cylinder; wherein:

the engine uses gasoline as fuel and is capable of operating with both homogeneous charge compression ignition and spark ignition;

the control unit at low speeds and/or loads of the engine controls the compression ratio variation mechanism to apply a first compression ratio in the cylinder and varies operation of the shutter means to reduce the effective area of the exhaust port during exhausting of combustion gases to trap combusted gases in the cylinder for mixing with subsequently introduced charge air and fuel to create a mixture suitable for homogeneous charge compression ignition;

the control unit at high speeds and/or loads of the engine controls the compression ratio variation mechanism to apply a second lower compression ratio in the cylinder and varies operation of the shutter means to increase the effective area of the exhaust port during exhausting of combusted gases to facilitate spark ignition without undesired pre-ignition;

the shutter means comprises a shutter and a transmission mechanism for oscillating the shutter between a first position in which the exhaust port has a first effective area and a second position in which the exhaust port has a second smaller effective area, the transmission mechanism being connected to a crankshaft connected to the piston of the engine and comprising a plurality of interconnected links;

the control unit varies the first position of the shutter with change in sensed operating characteristics to advance or retard the opening of the exhaust passage;

the shutter is in or close to the first position when the piston passes the shutter when moving from a top dead centre position thereof to a bottom dead centre position thereof;

the control unit varies the first position of the shutter by varying the amplitude of oscillation of shutter travel between the first and second positions thereof, the control unit decreasing the shutter movement to retard opening of the exhaust passage;

the second position of the shutter is constant for all engine operating conditions;

an electro-mechanical device is connected to one of the interconnected links, the electro-mechanical device being controlled by the control unit to alter the configuration of the interconnected links to vary the cyclical motion of the shutter; and the motion of the shutter during the period between the uncovering of the inlet ports by the piston and the piston reaching the bottom dead centre position thereof is motion towards the second position of the shutter, whereby the effective area of the exhaust port is reduced to reduce loss of fresh charge from the cylinder.

2. A two-stroke internal combustion engine as claimed in claim 1, wherein:

the compression ratio variation mechanism provides a wide varied range of compression ratios of the cylinder.

3. A two-stroke internal combustion engine as claimed in claim 1, wherein the transmission mechanism comprises a first shaft on which the shutter is mounted for cyclical motion on rotation of the first shaft and a second shaft connected by pulley means to the output crankshaft of the engine, the first and second shafts being connected by the plurality of interconnected links.

4. A two-stroke internal combustion engine as claimed in claim 1 wherein the shutter is pivotally mounted within a recess in the exhaust passage and the transmission mechanism oscillates the shutter between the first position in which the shutter is disposed wholly or partly within the recess and the second position in which the shutter extends out of the recess to reduce the effective area of the exhaust port.

5. A two-stroke internal combustion engine as claimed in claim 1 wherein the transmission mechanism comprises a first shaft attached to the shutter, a first link fixed at one end to the first shaft and pivotally connected at the other end to a first end of a second link, the second link being pivotally connected at a second end thereof to first ends of third and fourth links, the third link being pivotally connected at a second end thereof to a crankshaft which is connected to the working crankshaft of the engine and rotates therewith and the fourth link being pivotally connected at a second end thereof to a fifth link which is mounted for rotation about a fixed axis, rotation of the fifth link about the fixed axis varying the geometrical interconnection of the links such that the first position of the shutter is varied.

6. A two-stroke internal combustion engine as claimed in claim 5, wherein the fifth link is rotated about the fixed axis by the electro-mechanical device, the control unit varying the first position of the shutter with changes in engine speed, and/or load and/or temperature.

7. A two-stroke internal combustion engine as claimed in claim 6 wherein the electromechanical device is a servomotor.

8. A two-stroke internal combustion engine as claimed in claim 7 having inlet ports in the cylinder wall wherein the second position of the shutter is a position in which the lowest part of the shutter is below the highest point of the uppermost inlet port present in the cylinder.

9. An internal combustion engine as claimed in claim 8 wherein the control unit controls the shutter means to alter the amount by which the effective area of the exhaust port is varied in each cycle.

10. An internal combustion engine as claimed in claim 9 wherein the sensor means measures engine speed and generates a signal corresponding thereto.

11. An internal combustion engine as claimed in claim 10 wherein the sensor means measures engine load and generates a signal corresponding thereto.

12. An internal combustion engine as claimed in claim 11 wherein the sensor means measures the temperature of coolant used in the engine and generates a signal corresponding thereto.

13. An internal combustion engine as claimed in claim 12 wherein the sensor means measures a rotational speed of the output crankshaft of the engine to measure engine speed and the pressure of the gases in an inlet manifold of the engine to measure engine load.

14. A two-stroke internal combustion engine as claimed in claim 1, wherein the transmission mechanism comprises a first shaft on which the shutter is mounted for cyclical motion on rotation of the first shaft and a second shaft connected by pulley means to the output crankshaft of the engine, the first and second shafts being connected by the plurality of interconnected links.

15. A two-stroke internal combustion engine as claimed in claim 14 wherein the shutter is pivotally mounted within a recess in the exhaust passage and the transmission mechanism oscillates the shutter between the first position in which the shutter is disposed wholly or partly within the recess and the second position in which the shutter extends out of the recess to reduce the effective area of the exhaust port.

16. A two-stroke internal combustion engine as claimed in claim 15 wherein the transmission mechanism comprises a first shaft attached to the shutter, a first link fixed at one end to the first shaft and pivotally connected at the other end to a first end of a second link, the second link being pivotally connected at a second end thereof to first ends of third and fourth links, the third link being pivotally connected at a second end thereof to a crankshaft which is connected to the working crankshaft of the engine and rotates therewith and the fourth link being pivotally connected at a second end thereof to a fifth link which is mounted for rotation about a fixed axis, rotation of the fifth link about the fixed axis varying the geometrical interconnection of the links such that the first position of the shutter is varied.

17. A two-stroke internal combustion engine as claimed in claim 16, wherein the fifth link is rotated about the fixed axis by the electro-mechanical device, the control unit varying the first position of the shutter with changes in engine speed, and/or load and/or temperature.

18. A two-stroke internal combustion engine as claimed in claim 17 wherein the electromechanical device is a servomotor.

19. A two-stroke internal combustion engine as claimed in claim 18 having inlet ports in the cylinder wall wherein the second position of the shutter is a position in which the lowest part of the shutter is below the highest point of the uppermost inlet port present in the cylinder.

20. An internal combustion engine as claimed in claim 19 wherein the control unit controls the shutter means to alter the amount by which the effective area of the exhaust port is varied in each cycle.

21. An internal combustion engine as claimed in claim 20 wherein the sensor means measures engine speed and generates a signal corresponding thereto;

measures engine load and generates a signal corresponding thereto; and measures the temperature of coolant used in the engine and generates a signal corresponding thereto.

22. An internal combustion engine as claimed in claim 21 wherein the sensor means measures a rotational speed of the output crankshaft of the engine to measure engine speed and the pressure of the gases in an inlet manifold of the engine to measure engine load.

* * * * *